US005090942A

United States Patent [19]

Traise

[11] Patent Number: 5,090,942

[45] Date of Patent: Feb. 25, 1992

[54] LABEL WITH RECORD SHEET

[75] Inventor: John E. Traise, Palm Bay, Fla.

[73] Assignee: Moore Business Forms, Inc., Grand Island, N.Y.

[21] Appl. No.: 663,616

[22] Filed: Mar. 4, 1991

[51] Int. Cl.[5] ..... B41L 1/20; B41L 1/22

[52] U.S. Cl. ..... 462/66; 428/40; 428/137; 428/138; 462/84; 462/8; 462/25; 462/67; 283/81

[58] Field of Search ..... 428/40, 41, 42, 43, 428/137, 138; 462/2, 3, 6, 8, 17, 25, 53, 54, 55, 66, 67, 84; 283/81

[56] References Cited

U.S. PATENT DOCUMENTS

| | | | |
|---|---|---|---|
| 3,383,121 | 5/1968 | Singer | 462/66 |
| 3,501,365 | 3/1970 | Marshall | 161/38 |
| 4,021,060 | 5/1977 | Seeley et al. | 462/66 |
| 4,070,774 | 1/1978 | Staats et al. | 253/77 X |
| 4,121,961 | 10/1978 | Brunette et al. | 156/249 |
| 4,159,129 | 6/1979 | Lockhart | 462/67 |
| 4,204,706 | 5/1980 | Blum et al. | 283/21 |
| 4,246,307 | 1/1981 | Trautwein | 428/916 X |
| 4,394,038 | 7/1983 | Klein | 282/1 |
| 4,583,765 | 4/1986 | Messinger | 282/9 |
| 4,614,361 | 9/1986 | Foster | 282/8 |
| 4,674,771 | 6/1987 | Thompson II. | 462/66 |
| 4,747,618 | 5/1988 | Instance | 281/5 |
| 4,747,619 | 5/1988 | Sager | 462/67 |
| 4,798,401 | 1/1989 | Greig | 282/9 |
| 4,799,712 | 1/1989 | Biava et al. | 462/67 |
| 4,803,111 | 2/1989 | Mansell | 428/137 X |
| 4,833,122 | 5/1989 | Doll et al. | 462/8 X |
| 4,951,970 | 8/1990 | Burt | 283/67 |
| 4,963,412 | 10/1990 | Kokeguchi | 428/137 |

*Primary Examiner*—Paul A. Bell
*Attorney, Agent, or Firm*—Nixon & Vanderhye

[57] ABSTRACT

A simple label-type business form is provided that allows a record sheet to be produced at the same time that indicia is applied to the label. The business form includes a label construction having a top face on which indicia is readily applied and a bottom face containing pressure sensitive adhesive; a release sheet having at least one opening; and a self-imaging sheet held in contact with a release sheet on the opposite side of the release sheet from the label construction by the label construction pressure sensitive adhesive. The release sheet preferably has rows and columns of openings, at least three openings in each row and column, and the label construction is a sheet having a number of labels interconnected together, at least one release sheet opening being associated with each of the labels. The self-imaging sheet may have adhesive applied to its bottom face, and a release liner covering that adhesive so that the self-imaging sheet also is a label. Indicia applied on the top face of the label cosntruction—as by a writing instrument or an impact printer—is transferred to the self-imaging face and duplicated on the self-imaging sheet.

20 Claims, 1 Drawing Sheet

LABEL WITH RECORD SHEET

BACKGROUND AND SUMMARY OF THE INVENTION

Labels are a popular type of business form. Typically, labels have a one part construction. However there are many situations in which it is desirable to keep a record sheet of indicia applied to a label or a series of labels. Typically in the past this has required a multi-part form having additional fastening components that attach the record sheet to the label construction.

According to the present invention, a business form is provided with allows the production of a record sheet from a label or series of labels, however does not require accessory attaching structures. Rather the form is constructed in a simple manner merely by particularly constructing the release sheet disposed between the label and the record sheet.

According to one aspect of the present invention, a business form is provided which comprises the following elements: A label construction comprising a top face on which indicia may be readily applied, and a bottom face comprising pressure sensitive adhesive. A release sheet having means defining at least one opening therein, the means defining the opening in contact with the pressure sensitive adhesive of the bottom face of the label; and a self-imaging sheet held in contact with the release sheet on the opposite side thereof from the label construction by the label construction pressure sensitive adhesive, the self-imaging sheet for receipt of indicia applied to the label construction self-imaged thereon. Preferably the label construction comprises a sheet having a plurality of labels interconnected together, and the release liner comprises means defining at least one opening—such as a plurality of openings—in the release sheet associated with each of the labels. The self-imaging sheet may have a bottom face having a second adhesive thereon, such as a pressure sensitive adhesive covered by a release liner. The business form may consist of the recited elements, no additional structures being necessary for holding the components together.

According to another aspect of the present invention a method of constructing a record for a label is provided. The method comprises the steps of: (a) Stacking the label construction, self-imaging sheet, and release sheet so that the release sheet is sandwiched between the self-imaging face of the self-imaging sheet, and the bottom face of the label construction, the self-imaging sheet engaged by adhesive from the label construction. (b) Applying indicia on the top face of the label construction by impacting it, so that the impact transfers to the self-imaging face and is duplicated thereon. And, (c) detaching the label construction indicia-containing portion from the release sheet and applying it to a desired surface, and removing the self-imaging sheet from contact with the release sheet so that the self-imaging sheet provides a record copy of the label construction. The method may also comprise the further step (d) of after step (c), of activating the adhesive applied to the self-imaging sheet lower face, and applying it to a surface. Step (d) may preferably be practiced—where the adhesive is a pressure sensitive adhesive—by removing a release liner covering the pressure sensitive adhesive.

According to yet a further aspect of the present invention, a release sheet for a business form is provided, comprising: Material that will not adhere to adhesive, the sheet having means defining a plurality of openings therein disposed in columns and rows, each column and row having at least three openings therein, the openings being large enough to allow adherence of a first sheet on one side of the release sheet with adhesive on a second sheet on the opposite side of the release sheet.

It is the primary object of the present invention to provide a simple business form construction including a label with record copy. This and other objects of the invention will become clear from an inspection of the detailed description of the invention, and from the appended claims.

DETAILED DESCRIPTION OF THE DRAWINGS

Figure 1:
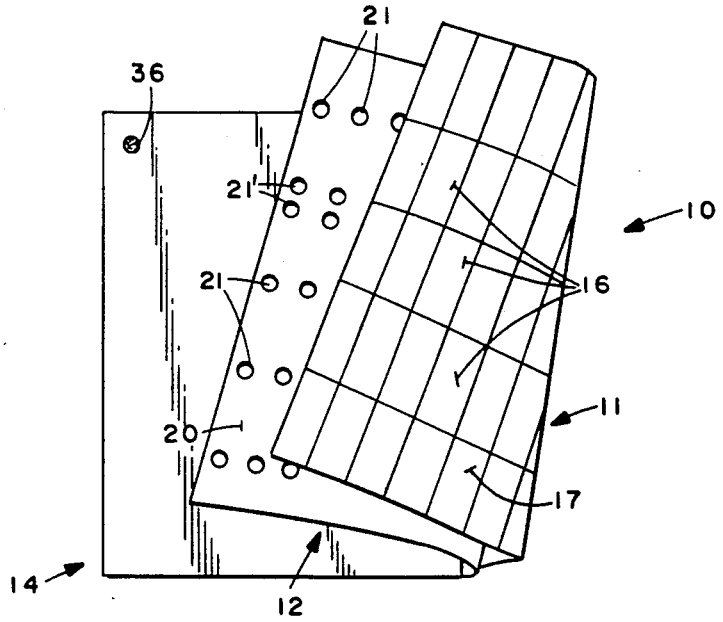
FIG. 1 is a top view, partly in perspective and partly in plan, showing exemplary components of a business according to the invention.
Figure 2:
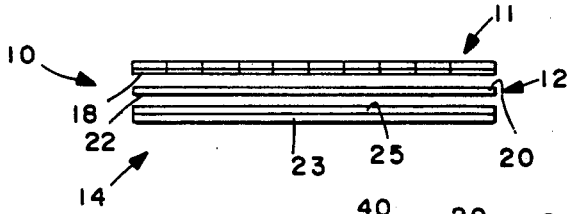
FIG. 2 is a side schematic view of the business form of FIG. 1 showing the relative components exaggerated in size for clarity of illustration.

A first embodiment of a business form according to the present invention is shown generally by reference numeral 10 in FIGS. 1 and 2. The business form 10 preferably consists of only three components; a label construction, designated generally by reference numeral 11, a release sheet designated generally by reference numeral 12, and a self-imaging sheet designated generally by reference numeral 14.

The label construction 11 comprises at least one label, but preferably a plurality of labels 16. The top face 17 of the label construction 11 is a face on which indicia may be readily applied, and the bottom face comprises pressure sensitive adhesive 18 (see FIG. 2). The label construction 11 typically is of conventional label materials, such as a bond paper sheet having a pressure sensitive adhesive 18 applied to one face thereof. The pressure sensitive adhesive 18 may be a repositional adhesive, such as utilized in commercial products sold by Moore Business Forms, Inc. of Grand Island, N.Y. under the trademark "NOTE STIX®", or may be of a more permanent type, such as a wide variety of conventional different types comprising a rubbery type elastomer combined with a liquid or solid resin tackifier component.

Figure 4:
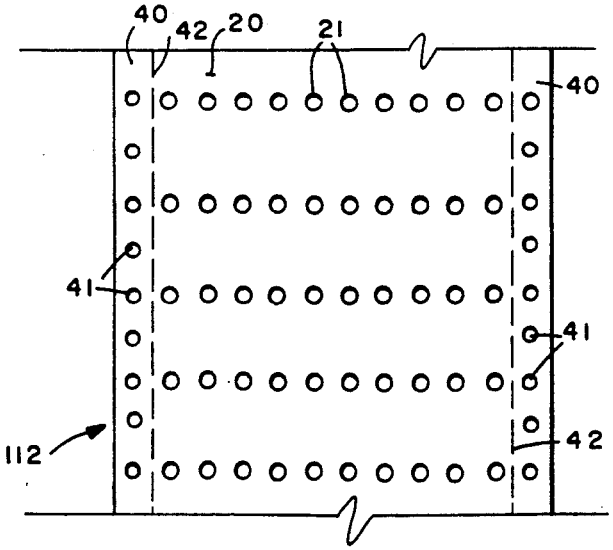
FIG. 4 is a top plan view of another embodiment of the release sheet of the business form according to the invention.

The release sheet 12 comprises a sheet having at least the top face 20 thereof of a material that will not permanently adhere to pressure sensitive adhesive. A wide variety of conventional materials could be used for the release sheet 12, such as glassine, bond material coated with a non-stick coating, or the like. The release sheet 12 has means defining at least one opening therein, and preferably defining a plurality of openings 21. As illustrated in FIGS. 1 and 4, the openings 21 preferably are disposed in rows and columns, at least three openings in each row and column, and at least one opening 21 corresponding to each label 16. Of course a plurality of openings—such as the openings 21' in FIG. 1—can be associated with an individual label 16.

The third element 14 comprises a conventional self-imaging sheet, such as a sheet 23 of bond paper (see FIG. 2) covered by a CFB self-imaging coating 25 The sheet 14 may have a construction such as the self-imaging sheet in U.S. Pat. No. 4,705,298, the disclosure of which is hereby incorporated by reference herein. The self-imaging sheet 14 is held in contact with the release sheet 12 bottom face 22 by the pressure sensitive adhesive 18. While the adhesive 18 properly holds the self-imaging sheet 14 in place in view of the pressure sensitive adhesive extending through the openings 21 and contacting the self-imaging sheet 14, the components 11, 12, and 14 may be disconnected without damage to the components in view of the nature of the adhesive 18 and the self-imaging coating 25.

Figure 3:
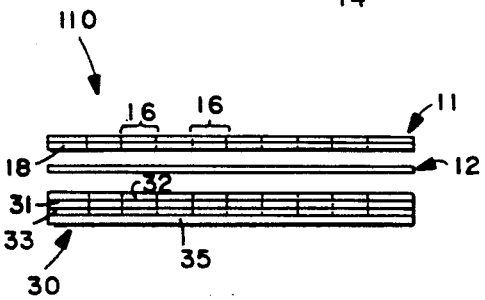
FIG. 3 is a view like that of FIG. 2 only for a second embodiment of business form according to the invention.

FIG. 3 illustrates a second embodiment of the business form according to the invention designated generally by reference numeral 110. For the business form 110, the components 11, 12 are identical to those described above. The component 14, however, is replaced with a component 30. The component 30 comprises a bond sheet 31 or the like having a self-imaging (CFB) coating 32 applied thereto on the top surface thereof, and a second adhesive—that is an adhesive additional to the adhesive 18—designated by reference numeral 33 is applied to the bottom face of the bond sheet 31. The adhesive 33 also may be a repositional adhesive, or a more permanent adhesive.

The elements 31–33 are preferably perfed, die-cut, or otherwise constructed so that they correspond to the labels 16 of the label construction sheet 11. If the second adhesive 33 is a pressure sensitive adhesive, then it is important to provide a release liner 35, of glassine or a similar release material which will not adhere to the adhesive 33, covering the face of the second adhesive 33.

When the adhesive 18 is a permanent adhesive, it is desirable to spot coat the coating 25 with a release material at those areas of coating 25 corresponding to openings 21. One such area is indicated at 36 in FIG. 1. The release coating may be a varnish of a silicone based wax, and prevents damage to coating 25 when the label construction is detached.

FIG. 4 illustrates a modified form of the release sheet according to the invention, designated generally by reference numeral 112. The sheet 112 has a top face 20 with a plurality of openings 21 therein, just as the sheet 12, but differs in providing one or more marginal portions 40 having tractor openings 41 disposed therein, and connected by a perf line 42 to the rest of the release sheet. The tractor drive portions 40 allow the form with which the release sheet 112 is associated to be driven through a tractor drive impact printer.

In the method of constructing a record for a label according to the present invention, first the label construction 10, self-imaging sheet 14, 30, and release sheet 12, 112 are stacked so that the release sheet 12, 112 is sandwiched between the self-imaging face 25, 32 of the self-imaging sheet 14, 30, and the bottom face of the label construction 11, the self-imaging sheet 14, 30 engaged by pressure sensitive adhesive 18 from the label construction 10. Then indicia is applied to the top face 17 of the label construction 11 by impacting it, so that the impact transfers to the self-imaging face 25, 32 and is duplicated thereon. The impacting may be done by an impact printer through which the form 10, 110 is passed in a sheet format, or in a continuous format (e.g. utilizing the release sheet 112 of FIG. 4). Of course indicia can also be applied with a writing instrument, or the like, or any other means that provides suitable pressure to transfer the image to the self-imaging material 25, 32.

After the indicia has been applied to the top face 17 of the label construction 11, the label construction indicia containing portion is detached from the release sheet 12 by peeling it back, and it is applied to a desired surface. The self-imaging sheet 14, 30 automatically is disconnected from the release sheet 12 when the labels 16 are removed since it is the adhesive 18 from the label 16 that holds the self-imaging sheet 14, 30 in place. If permanent adhesive 18 is used, the spot coatings 36 prevent damage to self-imaging coating 25 when the plies are separated.

When the self-imaging sheet 30 is provided, there is the further step of removing the release liner 35 from the second adhesive 33, and applying the record sheet to another surface, to which it is adhered by the adhesive 33. The business forms 10, 110 according to the present invention consist of the indicated elements. That is, no additional elements—such as additional attachment means (whether adhesive or mechanical)—are necessary to hold the components together.

It will thus be seen that according to the present invention a simple, advantageous business form allowing the production of a record copy of a label, has been provided, as well as a method of constructing a record for a label, and a particular release sheet component for the business form. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A business form, comprising:

a label construction comprising a top face on which indicia may be readily applied, and a bottom face comprising pressure sensitive adhesive;

a release sheet having means defining at least one opening therein, the means defining the opening in contact with the pressure sensitive adhesive of said bottom face of said label; and a self-imaging sheet held in contact with said release sheet on the opposite side thereof from said label construction by said label construction pressure sensitive adhesive, said self-imaging sheet for receipt of indicia applied to said label construction self-imaged thereon.

2. A business form as recited in claim 1 wherein said label construction comprises a sheet having a plurality of labels interconnected together, and wherein said release liner comprises means defining at least one opening therein associated with each of said labels.

3. A business form as recited in claim 2 wherein said pressure sensitive adhesive is a permanent adhesive, and wherein a spot coating of a release coating is provided on said self-imaging sheet at the portions thereof in alignment with said release sheet openings.

4. A business form as recited in claim 1 further comprising means defining a plurality of openings in said release sheet associated with said label construction.

5. A business form as recited in claim 1 wherein said adhesive is a first adhesive, and wherein said self-imaging sheet has a top face on which self-imaging material is provided, in contact with said release sheet, and a bottom face having a second adhesive thereon.

6. A business form as recited in claim 5 wherein said second adhesive on said bottom face of said self imaging sheet is pressure sensitive adhesive, and further comprising a release liner covering said second adhesive.

7. A business form as recited in claim 6 wherein said label construction comprises a sheet having a plurality of labels interconnected together, and wherein said release liner comprises means defining at least one opening therein associated with each of said labels.

8. A business form as recited in claim 6 consisting of said label construction, release sheet, self-imaging sheet, and release liner.

9. A business form as recited in claim 6 further comprising means defining a plurality of openings in said release sheet associated with said label construction.

10. A business form as recited in claim 9 wherein said label construction comprises a sheet having a plurality of labels interconnected together, and wherein said release liner comprises means defining at least one opening therein associated with each of said labels.

11. A business form as recited in claim 5 wherein said label construction comprises a sheet having a plurality of labels interconnected together, and wherein said release liner comprises means defining at least one opening therein associated with each of said labels.

12. A business form as recited in claim 1 consisting of said label construction, release sheet and self-imaging sheet.

13. A method of constructing a record for a label, utilizing a label construction having a top face on which indicia may be applied, and a bottom face coated with pressure sensitive adhesive, a self-imaging sheet having an upper self-imaging face, and a release sheet having at least one opening therein allowing the adhesive from the label construction to engage and hold the self-imaging sheet upper face, comprising the steps of:

(a) stacking the label construction, self-imaging sheet, and release sheet so that the release sheet is sandwiched between the self-imaging face of the self-imaging sheet, and the bottom face of the label construction, the self-imaging sheet engaged by adhesive from the label construction;

(b) applying indicia on the top face of the label construction by impacting it, so that the impact transfers to the self-imaging face and is duplicated thereon; and (c) detaching the label construction indicia-containing portion from the release sheet and applying it to a desired surface, and removing the self-imaging sheet from contact with the release sheet so that the self-imaging sheet provides a record copy of the label construction.

14. A method as recited in claim 13 wherein the self-imaging sheet has a lower face with adhesive thereon, and comprising the further step (d), after step (c), of activating the adhesive applied to the self-imaging sheet lower face, and applying it to a surface.

15. A method as recited in claim 14 wherein the adhesive on the self-imaging sheet lower face is a pressure sensitive adhesive covered by a release liner, and wherein step (d) is practiced by removing the release liner and applying the self-imaging sheet to a surface.

16. A method as recited in claim 15 consisting of steps (a) through (d).

17. A method as recited in claim 13 wherein step (b) is practiced by feeding the label construction, self-imaging sheet, and release sheet automatically through a printer.

18. A method as recited in claim 13 consisting of steps (a) through (c).

19. A release sheet for use in a business form construction constructed of material that will not adhere to adhesive, said sheet having means defining a plurality of openings therein disposed in columns and rows, each column and row having at least three openings therein, said openings being large enough to allow adherence of a first sheet on one side of said release sheet with adhesive on a second sheet on the opposite side of said release sheet.

20. A release sheet as recited in claim 19 in combination with a self-imaging sheet as said first sheet, and a label construction as said second sheet.

* * * * *